United States Patent [19]

Onishi et al.

[11] Patent Number: 4,889,033

[45] Date of Patent: Dec. 26, 1989

[54] PNEUMATIC ACTUATOR

[75] Inventors: Masayoshi Onishi; Tadayuki Fujimoto, both of Himeji, Japan

[73] Assignee: Mitsubishi Denki Kabushiki Kaisha, Tokyo, Japan

[21] Appl. No.: 216,051

[22] Filed: Jul. 7, 1988

[30] Foreign Application Priority Data

| | | | |
|---|---|---|---|
| Jul. 8, 1987 | [JP] | Japan | 62-105454 |
| Jul. 8, 1987 | [JP] | Japan | 62-105455 |
| Jul. 8, 1987 | [JP] | Japan | 62-105456 |
| Jul. 8, 1987 | [JP] | Japan | 62-105457 |
| Jul. 17, 1987 | [JP] | Japan | 62-110502 |
| Jul. 17, 1987 | [JP] | Japan | 62-110505 |

[51] Int. Cl.[4] ..... F01B 25/02

[52] U.S. Cl. ..... 91/6; 91/454; 91/459; 180/177

[58] Field of Search ..... 180/177; 91/6, 459, 91/454, 429; 123/349; 60/397

[56] References Cited

U.S. PATENT DOCUMENTS

| | | | |
|---|---|---|---|
| 4,249,457 | 2/1981 | Sakakibara | 91/459 X |
| 4,352,403 | 10/1982 | Burney | 180/176 |
| 4,709,595 | 12/1987 | Hayama | 180/177 X |
| 4,747,460 | 5/1988 | Tomoshige et al. | 180/177 X |
| 4,756,233 | 7/1988 | Takahashi et al. | 91/454 X |
| 4,756,234 | 7/1988 | Anderson | 91/454 |

*Primary Examiner*—Edward K. Look

*Attorney, Agent, or Firm*—Sughrue, Mion, Zinn, Macpeak and Seas

[57] ABSTRACT

In a pneumatic actuator wherein air pressure in a diaphragm compartment (38) is changed by controlling solenoid valves (39, 39 and 41) thereby to output a displacement; an intake solenoid valve (39) has a spring (**30*h*) which penetrates a center part of a fixed iron core (39*e*) and urges a movable iron core (39*f*), and the solenoid valves (39, 39 and 41) are mounted on a housing (31) in a triangular disposition with terminal side thereof faced to the housing (31), and besides, one of terminals of each solenoid valve (39 or 41**) is secured with each other at a center part of the triangular disposition, and the other terminals are disposed outward of the triangular disposition.

8 Claims, 11 Drawing Sheets

PNEUMATIC ACTUATOR

FIELD OF THE INVENTION AND RELATED ART STATEMENT

1. Field of the Invention

The present invention relates to a pneumatic actuator which is to be used, for instance, in a constant speed control system of a vehicle such as an automobile.

2. Description of the Related Art

FIG. 9 is a cross-sectional view of the conventional pneumatic actuator, and FIG. 10 is a right side view of FIG. 9 with its end cover 19 and a filter 18 removed. In these figures, a housing 1 is made of a synthetic resin. An outer edge 2*a* of a diaphragm 2 is engaged with a flange member 1*a* of the housing and held by a supporting plate 3 at an inside part thereof. An inner edge 2*b* of the diaphragm 2 is caught between the supporting plate 3 and a pushing plate 4 fixed to the supporting plate 3. A connection metal fitting 5 is fixed on a center part of the pushing plate 4. A transmitting wire (not shown) for transmitting a displacement of the diaphragm 2 is connected with the connection metal fitting 5. A case 6 holds the pushing plate 4 and pushes the outer edge 2*a* of the diaphragm 2 by an edge part 6*a* thereof. And this edge part 6*a* is pressed to fit over the flange member 1*a*. The diaphragm 2 is usually expanded by a compression spring 7 in a diaphragm compartment 8.

A pair of intake solenoid valves 9, 9, of which are fixed on the housing 1, connects/disconnects the diaphragm compartment 8 with/from the atmosphere through an atmosphere lead-in passage 10. FIG. 11 shows a cross-sectional enlarged view of the intake solenoid valves 9, 9 and an exhaust solenoid valve 11. In FIG. 11, a valve 9*g* is usually opened by receiving urge of a valve spring 9*h*, and thereby the diaphragm 2 is expanded. When an exciting coil 9*a* is electrified, the valve 9*g* is closed, thereby to stop intaking of the atmosphere. One of solenoid valves 39, 39 is used for making ON-OFF control, and the other is closed during constant-speed-cruising of the car and is opened for making rapid intake at the time when the constant-speed-cruising is canceled.

An exhaust solenoid valve 11, which is fixed on the housing 1, has a negative pressure exhaust pipe 12 which is to be connected with a negative pressure suction device (not shown). In this solenoid valve 11, the valve 11*g* is usually closed by receiving urge of a valve spring 11*h*. When an exciting coil 11*a* is electrified, the valve 11*g* opens, and thereby air in the diaphragm compartment 8 (FIG. 9) is exhausted out of the negative pressure exhaust pipe 12 by the negative pressure suction device. As a result, the diaphragm 2 is contracted.

As shown in FIG. 9, the intake solenoid valves 9, 9 and the exhaust solenoid valve 11 are fixed on a bottom part of the housing 1 and hermetically sealed by O rings 21 and 22.

Next, constructions of the intake solenoid valves 9, 9 are described in detail. In FIG. 11, the exciting coil 9*a* is wound on a bobbin 9*b*, and a terminal 9*c* is led out of the bobbin 9*b*. A fixed iron core 9*e* is fixed to the bobbin 9*b* and is sealed with each other by an O ring 23 fitted on the fixed iron core 9*e*. A plunger 9*f* which serves as a movable iron core is movably held by the bobbin 9*b*. A hexagonal outer surface of the plunger 9*f* forms an air passage between itself and the bobbin 9*b*, and the valve 9*g* is formed between the plunger 9*f* and the fixed iron core 9*e*. The plunger 9*f* is usually urged to move leftward of the figure by the valve spring 9*h*, thereby to open the valve 9*g*. A holder 9*i*, which is made of a synthetic resin, holds an end part of the bobbin 9*b* via a metal plate 9*j* forming a magnetic path. This holder 9*i* holds an end of the plunger 9*f* and has a vent 9*k* therein. And, another holder 9*l*, which is made of the synthetic resin, holds the other end part of the bobbin 9*b* via a metal plate 9*m* forming the magnetic path. A cylindrical yoke 9*n* holds the holder 9*i* at one end thereof and is pressed to hold the holder 9*l* at the other end thereof, thereby to form a frame. An O ring 24 is fitted between the bobbin 9*b* and the holder 9*i*, and an O ring 21 is fitted between the holder 9*i* and a bottom part of the housing 1.

Next, constructions of the exhaust solenoid valve 11 is described in detail. In FIG. 11, an exciting coil 11*a* is wound on a bobbin 11*b*, and a terminal 11*c* is led out of the bobbin 11*b*. A fixed iron core 11*e* is fixed to the bobbin 11*b* and is sealed with each other by an O ring 23 fitted on the fixed iron core 11*e*. An exhaust passage 11*q* is formed by penetrating a center part of the fixed iron core 11*e*. A plunger 11*f* which serves as a movable iron core is movably held by the bobbin 11*b*. A hexagonal outer surface of the plunger 11*f* forms an air exhaust passage between itself and the bobbin 11*b*, and the valve 11*g* is formed between a conical end part 11*q* of the plunger 11*f* and a holder 11*i* faced on this end part 11*q* of the plunger 11*f*. The plunger 11*f* is usually urged to move rightward of the figure by the valve spring 11*h*, thereby to close the valve 11*g*. A holder 11*i*, which is made of a synthetic resin, holds an end part of the bobbin 11*b* via a metal plate 11*j* forming a magnetic path. This holder 11*i* has a valve bank 11*p* faced to the end part 11*q* of the plunger 11*f* and a vent 11*k* therein. And, another holder 11*l*, which is made of the synthetic resin, holds the other end part of the bobbin 11*b* via a metal plate 11*m* forming the magnetic path. A cylindrical yoke 11*n* holds the holder 11*i* at one end thereof and is pressed to hold the holder 11*e* at the other end thereof, thereby to form a frame. An O ring 24 is fitted between the bobbin 11*b* and the holder 11*i*, and an O ring 22 is fitted between the fixed iron core 11*e* and a bottom part of the housing 1.

In FIG. 10, lead wires 13*a* and 13*b* are soldered with a pair of terminals 9*c* and 9*c* of each solenoid valve 9, respectively. These connection parts are covered by insulation resin 14. The solenoid valve 11 is mounted in the housing 1 in such a manner that a terminal side thereof is opposite to that of the solenoid valve 9. Lead wires 13*c* and 13*d* are soldered with a pair of terminals (not shown) of the solenoid valve 11, and drawn out to the outside of the pneumatic actuator through a circumference of the solenoid valve 11 beside the housing 1. These connection parts are also covered by the insulation resin (not shown). The lead wires 13*b*, 13*d* and a common lead wire 13*e* are connected with each other by a plug-in connector (not shown). The lead wires 13*a*, 13*a*, 13*b*, 13*c* and 13*e* are clamped by a wire clamp 15 and drawn out to the outside of the pneumatic actuator with a predetermined length of wire for external wirings.

In FIG. 9, a pushing plate 17 pushes the solenoid valves 9, 9, and 11, and a filter 18 is fitted on the pushing plate 17. An end cover 19 is secured to the housing 1 by screws (not shown) from an external side of the pushing plate 17, and a fixing frame 20 is fixed on a case 6.

Next, operation of the above-mentioned conventional pneumatic actuator, which is used in a constant speed control system (not shown) of a car is described. When a desired speed of the car which is to be maintained constant is set, the set speed and an actual speed of the car are compared in the constant speed control system.

When the actual speed of the car is slower than the set speed, the exhaust solenoid valve 11 is turned on and off continuously in such a manner that ON-time is increased against OFF-time responding to a deviation value between the actual speed and the set speed. On the other hand, one of the two intake solenoid valves 9, which is the one for ON-OFF control, is turned on and off continuously in such a manner that ON-time is decreased against OFF-time in inverse proportion to the deviation value between the actual speed and the set speed. The other intake solenoid valve 9 is kept closed.

When the actual speed of the car is faster than the setting speed, ON-OFF conditions of both solenoid valves 9, 9 and 11 are controlled in a reverse manner mentioned in the above.

Thus, a displacement, which is outputted from the pneumatic actuator, is controlled. When the above-mentioned deviation value comes to zero, both ON-OFF controls of the solenoid valves 9, 9 and 11 are stopped and the displacement in that moment is maintained, thereby to cruise the car by a constant speed. When the deviation value between the actual speed of the car and the setting speed grows to a predetermined value, the above-mentioned ON-OFF control of the solenoid valves 9, 9 and 11 is executed again in order to eliminate this deviation value.

In the above-mentioned conventional pneumatic actuator, there exist some problems in the following.

(i) Since the two intake solenoid valves 9, 9 and the one exhaust solenoid valve 11 are disposed in such a manner that disposition of the terminal 9*c* of the solenoid valve 9 is opposite to the terminal (not shown) of the solenoid valve 11, it takes a long time to assemble the solenoid valves 9, 9 and 11 into the pneumatic actuator.

(ii) It takes a long time to solder the lead wires 13*a*, 13*b*, 13*c* and 13*d* with the terminals 9*c* and to lead out many (seven) wires, and a wiring space is required, thereby resulting in enlargement of a size of this pneumatic actuator.

(iii) Since a length of the valve spring 9*h* of the intake solenoid valve 9 is short, the valve spring 9*h* may tumble, thereby resulting in inclination of the plunger 9*f*. And thereby the valve 9*g* may be imperfectly closed with leakage of air, or action of the plunger 9*f* lacks smoothness. Further, a spring constant of the valve spring 9*h* is too large to have a quick responsibility, and a transient characteristic of the valve spring 9*h* is not excellent. Therefore, performance of the constant speed control unit is not stabilized. Hereupon, since the quick responsibility is not regarded as an important function to the exhaust solenoid valve 11, the transient characteristic of slow response thereof is of no matter.

OBJECT AND SUMMARY OF THE INVENTION

The objects of the present invention is to offer such a pneumatic actuator that:

(I) solenoid valves are easily mounted, (II) lead wires are easily and quickly connected to terminals in a minimized wiring space, and (III) a plunger moves smoothly with quick responsibility and closes a valve perfectly, by receiving urge of a spring mounted easily with a small spring constant.

In order to achieve the above-mentioned objects, a pneumatic actuator comprises:

a housing;

a case which forms an enclosed space therein together with the housing;

a diaphragm which is held in the space to form a diaphragm compartment and expands/contracts by change of an internal air pressure thereof thereby to output a displacement out of the case;

a spring which is hold in the diaphragm compartment for expanding the diaphragm;

a pair of intake solenoid valves which connect/disconnect the diaphragm compartment with/from atmosphere and each of which comprises a fixed iron core through which a passage is formed for intaking air in an axial direction thereof, a movable iron core for opening/closing a valve and a spring which pushes the movable iron core by an end thereof to open the valve;

an exhaust solenoid valve which connects/disconnects the diaphragm compartment with/from negative pressure suction source;

a yoke which holds the intake solenoid valves and the exhaust solenoid valve and is fixed on the housing; and a cover which covers the intake solenoid valves and the exhaust solenoid valve and receives the other end of the spring of the intake solenoid valve; wherein the intake solenoid valves and the exhaust solenoid valve are disposed in a triangular disposition with terminal side thereof faced to the housing, and one of terminals of each solenoid valve is secured with each other at a center part of the triangular disposition, and the other terminal of each solenoid valve is disposed outward of the triangular disposition, and wherein the spring of each intake solenoid valve passes through the passage.

BRIEF DESCRIPTION OF THE DRAWINGS

in FIG. 7.

in FIG. 9.

DESCRIPTION OF THE PREFERRED EMBODIMENT

Figure 1:
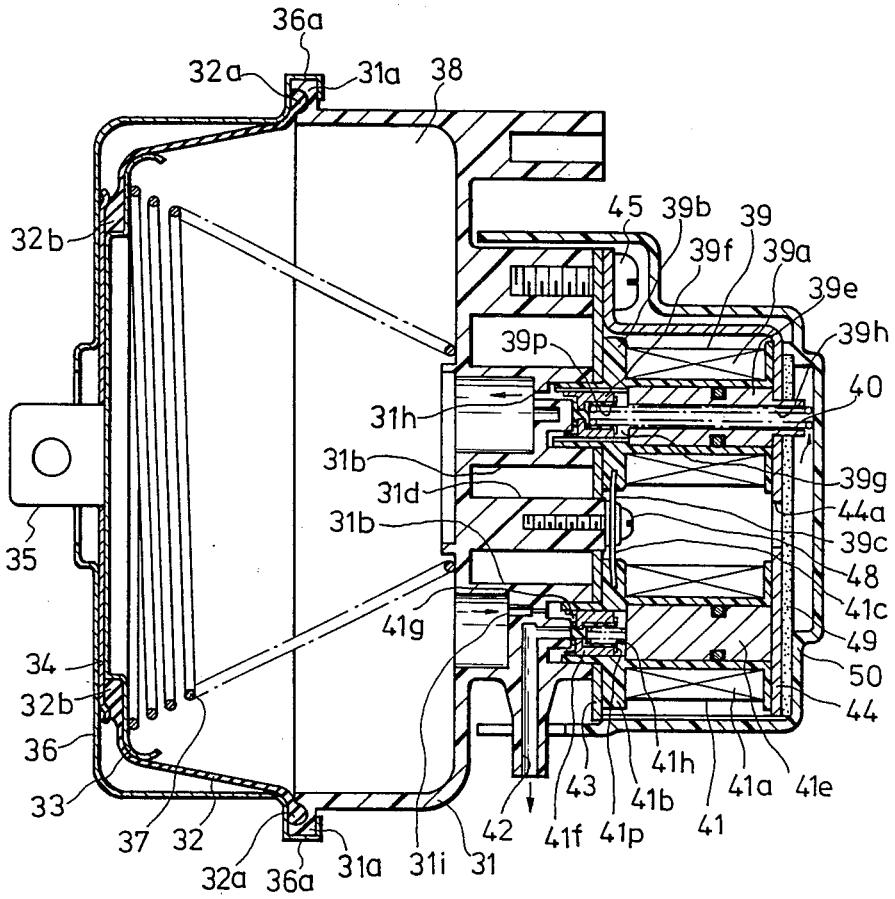
FIG. 1 is a cross-sectional view showing a first embodiment of a pneumatic actuator of the present invention.
Figure 2:
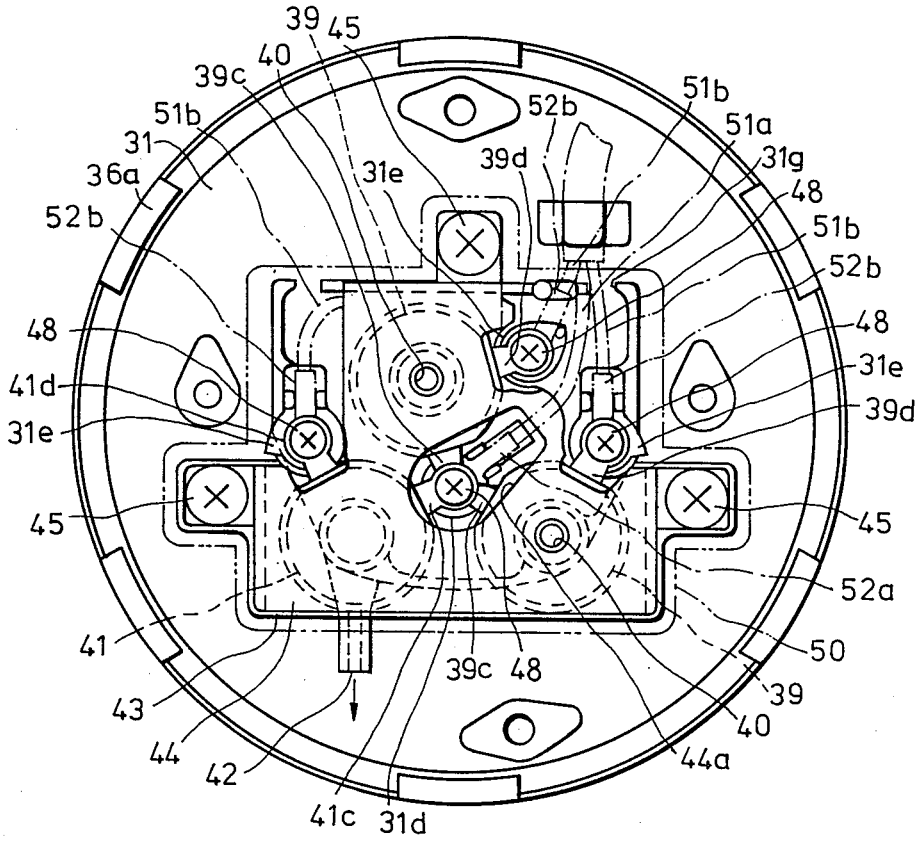
FIG. 2 is a right side view of FIG. 1 after removal of a cover 50 and a filter 49.

Hereafter, preferred embodiments of the present invention is described with reference to the accompanying drawings. FIG. 1 shows a cross-sectional view of an embodiment of a pneumatic actuator, and FIG. 2 shows a right side view after removal of a cover 50 and a filter 411 in FIG. 1. In these figures, a housing 31 is made of a synthetic resin, and a diaphragm 32 is made of such an elastic material as a rubber. An outer edge 32*a* of the diaphragm 32 is engaged with a flange member 31*a* of the housing 31, and the diaphragm 32 is held by a supporting plate 33 at an inside part thereof. An inner edge 32*b* of the diaphragm 32 is caught between the supporting plate 33 and a pushing plate 34 fixed to the supporting plate 33. And a connection metal fitting 35 is fixed on a center part of the pushing plate 34. A transmitting wire for transmitting a displacement of the diaphragm 32, which is not shown in the figure, is connected with the connection metal fitting 35. A case 34 holds the pushing plate 34 and pushes the outer edge 32*a* of the diaphragm 32 by an edge part 36*a* thereof, and this edge part 36*a* is pressed to fit over the flange member 31*a*. The diaphragm 32 is expanded by a compression spring 37 in a diaphragm compartment 38.

A pair of intake solenoid valves 39, 39 are constructed as follows. An exciting coil 39*a* is wound on a bobbin 39*b*, and a common side terminal 39*c* and an individual side terminal 39*d* (FIG. 2) are provided out of the bobbin 39*b*. A fixed iron core 39*e*, which has an atmosphere lead-in passage 40 at a center part thereof, is fixed to the bobbin 39*b*. A plunger 39*f* which serves as a movable iron core has a buffer rubber 39*p* fitted thereon. This plunger 39*f* is urged to move leftward of the figure by a valve spring 39*h*, and thereby a valve 39*g* is opened between the fixed iron core 39*e* and the plunger 39*f*. Thereby, the atmosphere lead-in passage 40 is open and the diaphragm 32 is set in an expanded state. An intake orifice 31*h* which is formed in the housing 31 is connected to the diaphragm compartment 38. When the exciting coil 39*a* is electrified, the plunger 39*f* is attracted to the fixed iron core 39*e*, thereby to close the valve 39*g*. One of solenoid valves 39, 39 is used for making ON-OFF control, and the other is closed during constant-speed-cruising of the car and is used for making rapid intake at the time when the constant-speed-cruising of the car is canceled.

An exhaust solenoid valve 41 is constructed as follows. An exciting coil 41*a* is wound on a bobbin 41*b*, and a common side terminal 41*c* and an individual side terminal 41*d* (FIG. 2) are provided out of the bobbin 41*b*. A fixed iron core 41*e* is fixed to the bobbin 41*b*, and a plunger 41*f* which serves as a movable iron core has a buffer rubber 41*p* fitted thereon. This plunger 41*f* is urged to move leftward of the figure by a valve spring 41*h*, and thereby a valve 41*g*, which is connected to a negative pressure exhaust pipe 42 formed in the housing 31, is closed. An exhaust orifice 31*i* which is formed in the housing 31 is connected to the diaphragm compartment 38. When the exciting coil 41*a* is electrified, the plunger 41*f* is attracted to the fixed iron core 41*e*, thereby to open the valve 41*g*. And, air in the diaphragm compartment 38 is exhausted through the negative pressure exhaust pipe 42 by a negative pressure suction device (not shown) and thereby the diaphragm 32 is contracted.

The solenoid valves 39, 39 and 41 are supported by a yoke 43 at the plunger's side and put between the yoke 43 and a yoke frame 44 which is bent at an intermediate part thereof. These yoke 43 and yoke frame 44 are secured to the housing 31 by a screw 45. The solenoid valves 39, 39 and 41 are disposed on vertexes of a triangle which is formed by three axial lines of the solenoid valves 39, 39 and 41 with the terminal side thereof faced to the yoke 43. The common side terminals 39*c* and 41*c* are piled at a center part of the triangle and secured to a terminal base 31*d* of the housing 31 by a screw 48 together with a terminal 52*a* of a common lead wire 51*a*. Individual side terminals 39*d* and 41*d* of the respective solenoid valves 39, 39 and 41 are directed outward of the triangle and secured to each terminal base 31*e* of the housing by the screw 48 together with a terminal 52*b* of each lead wire 51*b*.

In FIG. 1, the filter 49 is put on one surface of the yoke frame 44, thereby to cover a vent 44*a*. The cover 50, which is made of a synthetic resin, is engaged with the yoke 43 and covers over the yoke 43 and the yoke frame 44. This cover 50 has openings (not shown) through which lead wires 51*a* and 51*b* are passed on a side part thereof. A fixing frame (not shown) is fixed on the case 36.

In FIG. 1, when this pneumatic actuator is mounted on the car in such a manner that the solenoid valves 39, 39 and 41 are positioned upward and the diaphragm compartment 38 is positioned downward, the cover 50 covers not only top and side portions of the solenoid valves 39, 39 and 41 but also a fixing base 31*b* for solenoid valve by an extended lower skirt part thereof. Therefore, the solenoid valves 39, 39 and 41 are protected against dripping water from upper. In a periphery of the fixing base 31*b*, a cut-off part 31*g* (FIG. 2) is formed, and thereby the water drains out of the cut-off part 31*g* without stagnating on a bottom of the housing 31. Further, in FIG. 1, since the cover 50 is mounted on the solenoid valves 39, 39 and 41 with a gap formed inbetween, the exciting coils 39*a*, 39*a* and 41*a* are exposed to the flowing air, thereby to get cooled.

Figure 11:
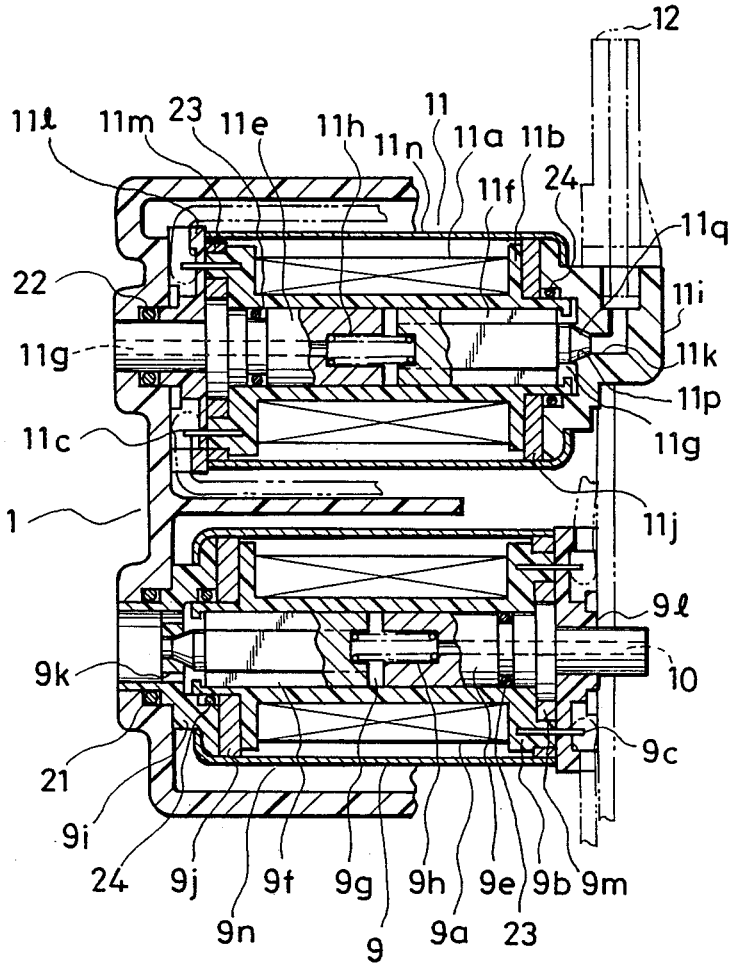
FIG.11 (Prior Art)
FIG. 11 is the cross-sectional enlarged view showing the solenoid valves 9, 9 and 11 etc.

In FIG. 1, the valve spring 39*h* pushes the plunger 39*f* of the intake solenoid valve 39 and passes through the atmosphere lead-in passage 40. And, the valve spring 39*h* is supported by the cover 50 at one end thereof. This valve spring 39*h* is sufficiently long and has a small spring constant. Therefore, this valve spring 39*h* does not tumble, and the plunger 39*f* does not incline. When the exciting coil 39*a* is electrified, the plunger 39*f* is attracted to the fixed iron core 39*e*, thereby to touch an end of the fixed iron core 39*e* via the buffer rubber 39*p*. Thereby, the valve 39*g* is closed to prevent flowing-in of the atmosphere perfectly. In comparison with the prior art as shown in FIG. 11, a length of the plunger 39*f* is shortened, and a weight thereof is reduced.

Next, operation of the above-mentioned pneumatic actuator, which is used in a constant speed control system (not shown) of a motor car, is elucidated. When a desired speed of the car which is to be maintained constant is set, the set speed and an actual speed of the car are compared by the constant speed control system.

When the actual speed of the car is slower than the set speed, the exhaust solenoid valve 41 is turned on and off continuously in such a manner that ON-time is increased against OFF-time responding to a deviation value between the actual speed and the set speed. On the other hand, one of the intake solenoid valve 39, which is the one for ON-OFF control, is turned on and off continuously in such a manner that ON-time is decreased against OFF-time in inverse proportion to the deviation value between the actual speed and the set speed. The other intake solenoid valve 39 is kept closed.

When the actual speed of the car is faster than the set speed, ON-OFF conditions of both solenoid valves 39, 39 and 41 are controlled in a reverse manner mentioned in the above.

Thus, a displacement, which is outputted from the pneumatic actuator, is controlled. When the above-mentioned deviation value comes to zero, both ON-OFF controls of the solenoid valves 39, 39 and 41 are stopped and the displacement in that moment is maintained, thereby to cruise the car by a constant speed. When the deviation value between the actual speed of the car and the setting speed grows to a predetermined value, the above-mentioned ON-OFF control of the solenoid valves 39, 39 and 41 is executed again in order to eliminate this deviation value.

Figure 3:
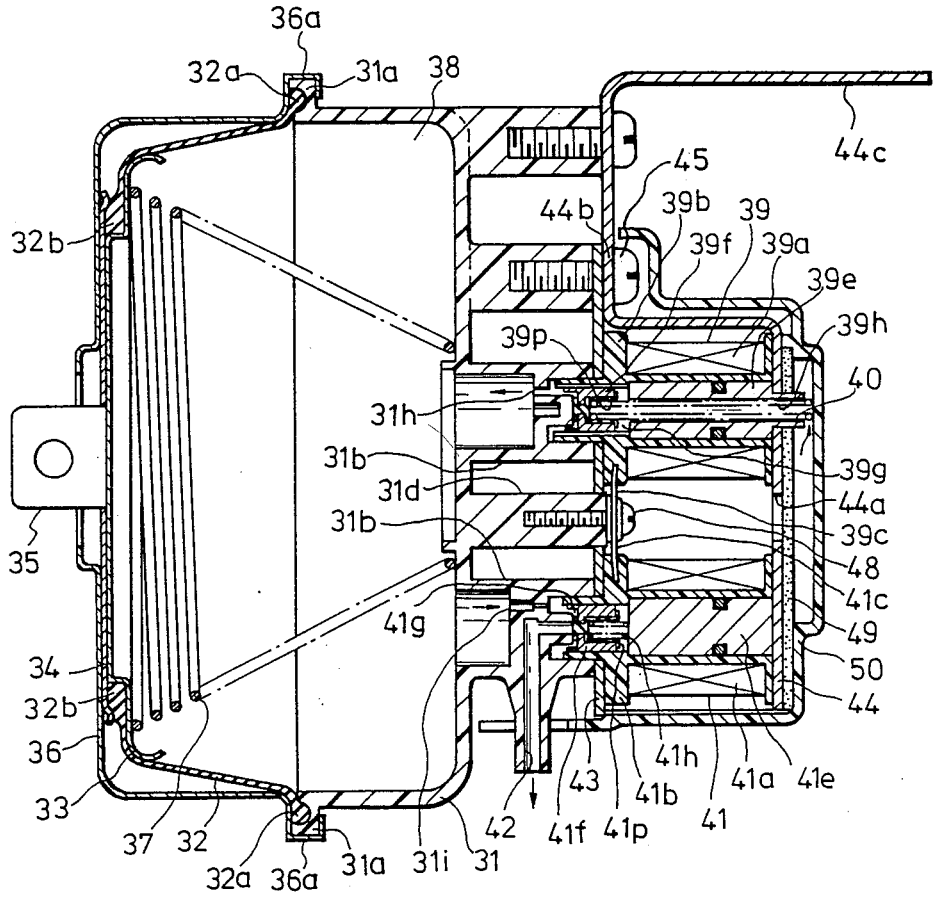
FIG. 3 is a cross-sectional view showing second embodiment of a pneumatic actuator of the present invention.
Figure 4:
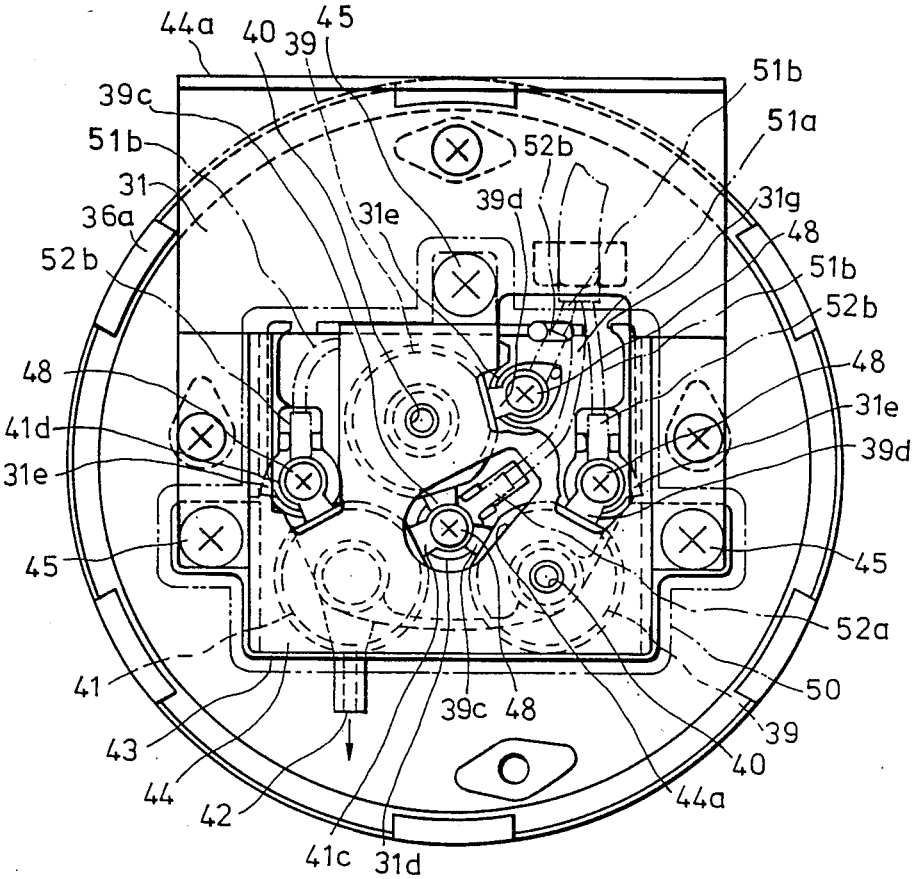
FIG. 4 is a right side view of FIG. 3 after removal of a cover 50 and a filter 49.

Next, a second embodiment of the present invention is described. FIG. 3 shows a cross-sectional view of this embodiment, and FIG. 4 shows a right side view of FIG. 3 after removal of the cover 50 and the filter 49. This embodiment is similar to the first embodiment as shown in FIG. 1 except the following. That is, a flange part 44*b* of the yoke frame 44 is prolonged out of the cover 50 and bent toward an axial direction of the solenoid valve 39 or 41 as shown in the figure. Since a prolonged part 44*c* serves as a radiation plate having a large radiation area, heat from the solenoid valves 39, 39 and 41 is effectively radiated at the prolonged part 44*c*. Therefore, temperature rise of the exciting coils 39*a*, 39*a* and 41*a* is reduced. And thereby, reduction of exciting current, which is caused by increase of resistance owing to high temperature, is avoidable. As a result, lowering of the attracting force by the plunger 39*f*, 39*f* and 41*f*, hence lowering of the driving force for the actuator, is prevented.

In the above-mentioned embodiment, although the prolonged part 44*c* of the yoke frame 44 is used also to serve for radiating the heat of each solenoid valve 39 or 41, the prolonged part 44*c* can be used also to serve as:

(a) a fixing frame of the actuator, (b) a heat sink whereon semiconductors of a control circuit which controls to electrify the exciting coil of the solenoid valve are mounted, or (c) a common earth plate for the exciting coil of the solenoid valve or a semiconductor unit of the control circuit.

Figure 5:
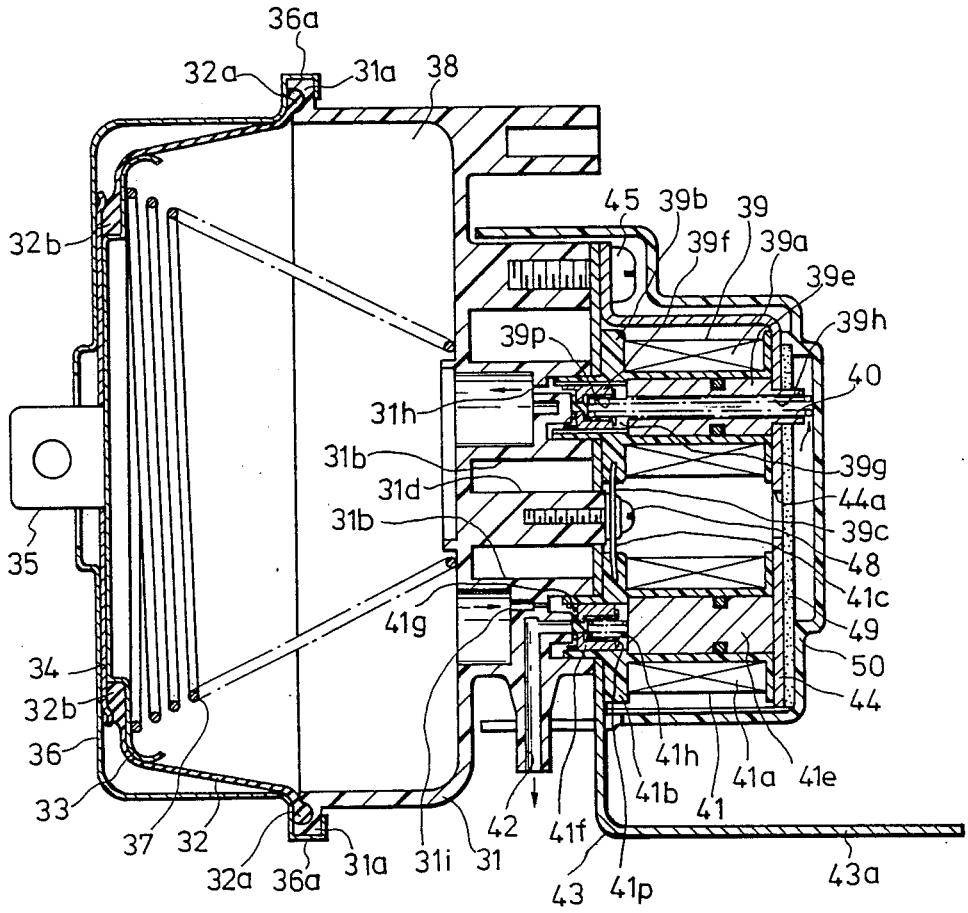
FIG. 5 is a cross-sectional view showing a third embodiment of a pneumatic actuator of the present invention.
Figure 6:
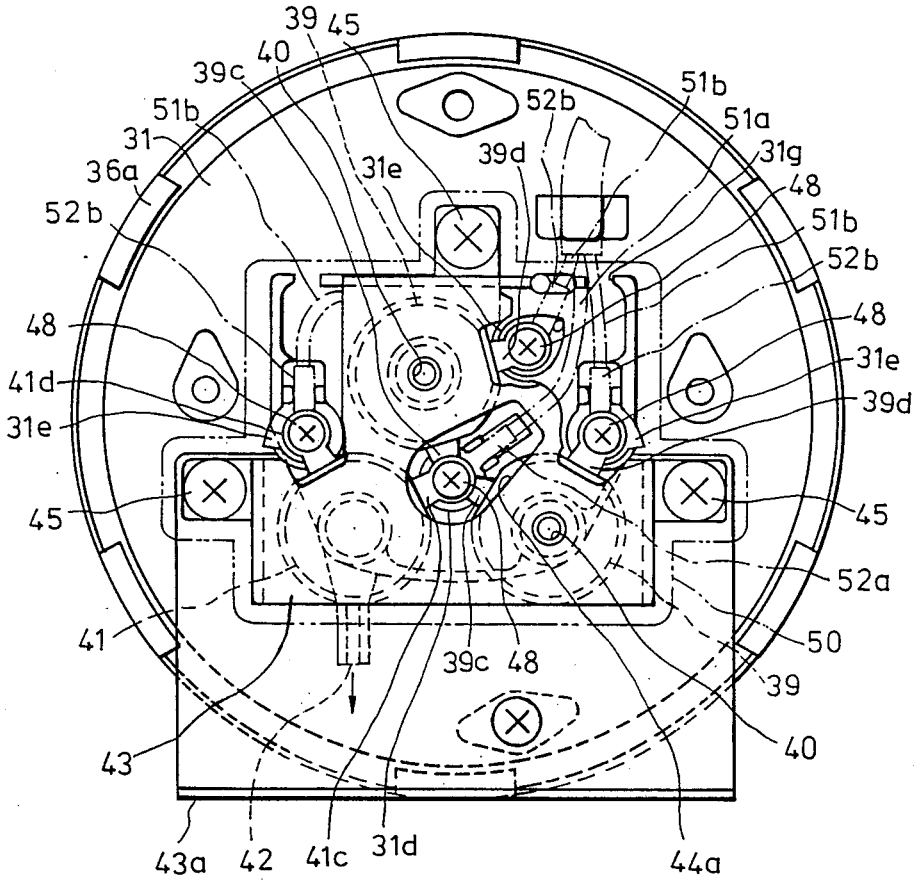
FIG. 6 is a right side view of FIG. 5 after removal of a cover 50 and a filter 49.
Figure 8:
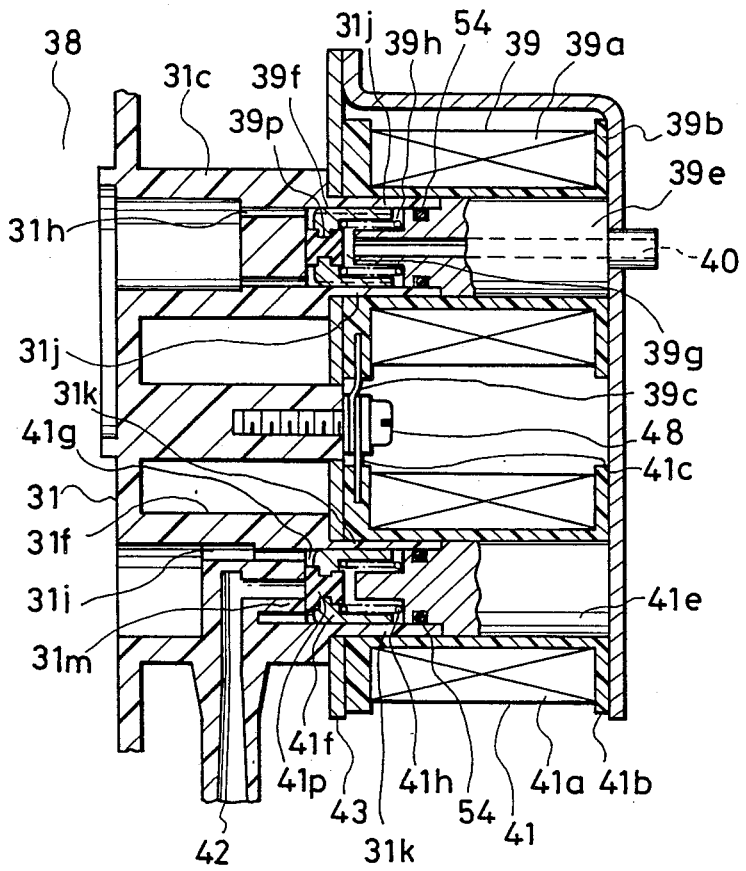
FIG. 8 is a cross-sectional enlarged view showing solenoid valves 39, 39 and 41 etc.
Figure 9:
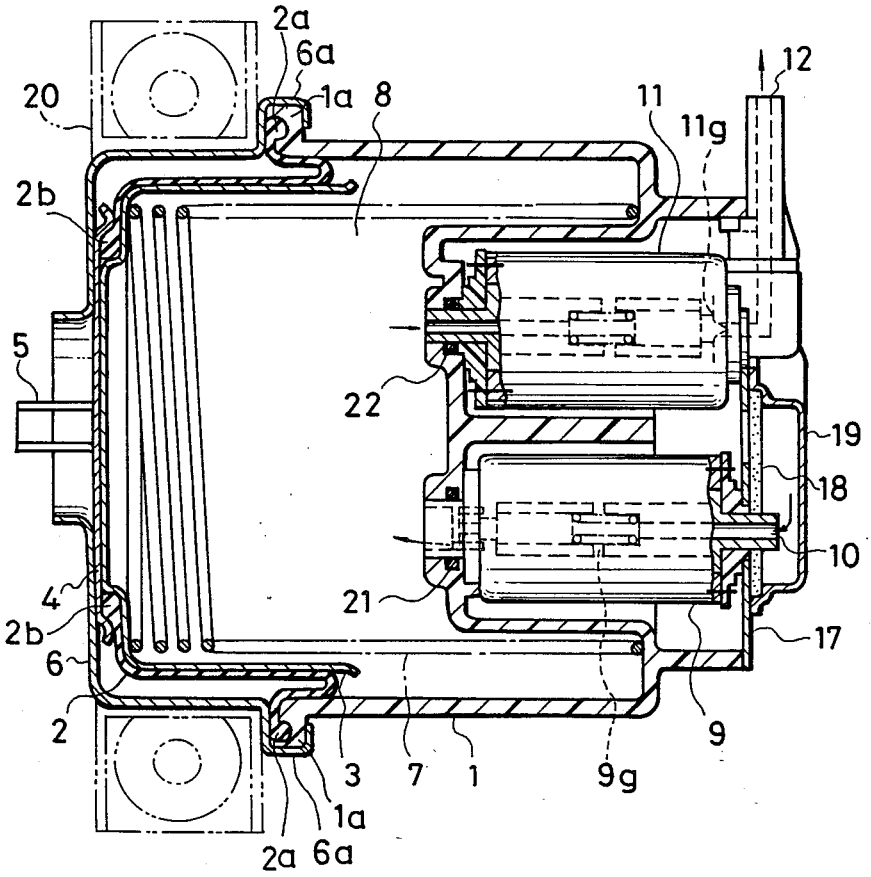
FIG. 9 (Prior Art)
FIG. 9 is the cross-sectional view showing the conventional pneumatic actuator.
Figure 10:
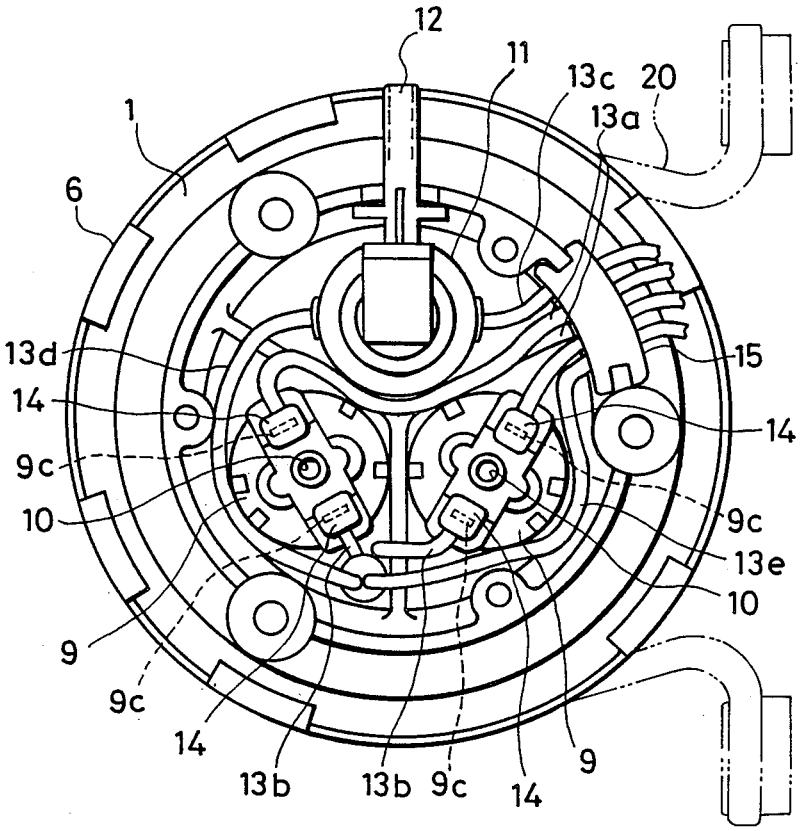
FIG.10 (Prior Art)
FIG. 10 is the right side view of FIG. 9 after removal of the end cover 19 an the filter 18.

Next, a third embodiment of the present invention is described. FIG. 5 shows a cross-sectional view of this embodiment, and FIG. 8 shows a right side view of FIG. 5 after removal of the cover 50 and the filter 49. This embodiment is similar to the first embodiment as shown in FIG. 1 except the following. That is, an end part of the yoke 43 is prolonged out of the cover 50 and bent toward an axial direction of the solenoid valve 39 or 41 as shown in the figure. Since a prolonged part 43*a* serves as a radiation plate having a large radiation area, heat from the solenoid valves 39, 39 and 41 is effectively radiated at the prolonged part 43*a*. Therefore, temperature rise of the exciting coils 39*a*, 39*a* and 41*a* is reduced. And thereby, reduction of exciting current, which is caused by increase of resistance owing to high temperature, is avoidable. As a result, lowering of the attracting force by the plunger 39*f*, 39*f* and 41*f*, hence lowering of the driving force for the actuator, is prevented.

In the above-mentioned embodiment, although the prolonged part 43*a* of the yoke 43 is used for radiating the heat of each solenoid valve 39 or 41, the prolonged part 43*a* can be also served as the aforementioned (a), (b) and (c) in the second embodiment.

Figure 7:
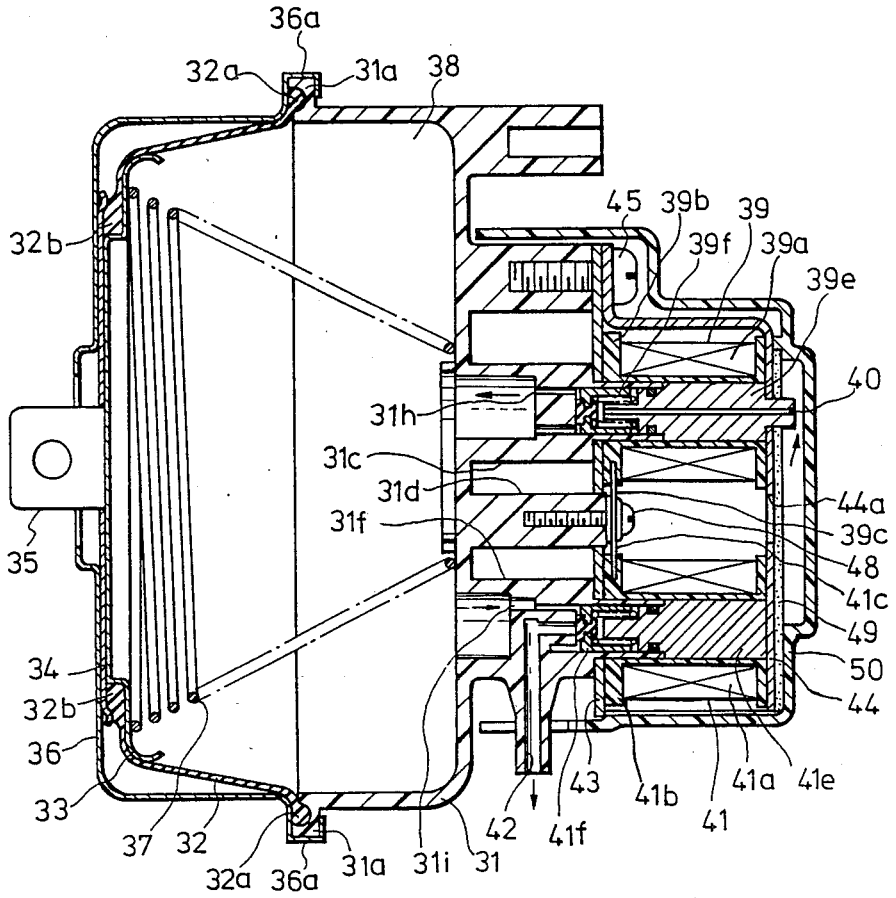
FIG. 7 is a cross-sectional view of a fourth embodiment of a pneumatic actuator of the present invention.

Next, a fourth embodiment of the present invention is described. FIG. 7 shows a cross-sectional view of this embodiment, and FIG. 8 shows an enlarged view of solenoid valves 39, 39 and 41 in FIG. 7. This embodiment is similar to the first embodiment except the following. In these figures, two fixing bases 31*c* for the solenoid valve 39 and one fixing base 31*f* for the solenoid valve 41 are formed on the housing 31. The fixing base 31*e* has a cylindrical projected part 31*j* thereon. Each intake solenoid valve 39 is inserted on this projected part 31*j* and mounted on the yoke 43. Also, the fixing base 31*f* has a cylindrical projected part 31*k* thereon, and the exhaust solenoid valve 41 is inserted on this projected part 31*k* and mounted on the yoke 43.

Construction of a pair of intake solenoid valves 39, 39 is described with reference to FIG. 8. An exciting coil 39*a* is wound on a bobbin 39*b*, and a pair of terminals 39*c* are provided out of a bobbin 39*b*. The bobbin 39*b* is inserted on a circumference of the cylindrical projected part 31*j*. A fixed iron core 39*e*, which has an atmosphere lead-in passage 40 at a center part thereof, is inserted into the projected part 31*j* and fixed within the bobbin 39*b*. An O ring 54 is fitted on the fixed iron core 39*e*. A plunger 39*f*, which serves as a movable iron core by being movably held in the cylindrical projected part 31*j*, has a buffer rubber 39*p* fitted thereon. This plunger 39*f* is urged to move leftward of the figure by a valve spring 39*h*, and thereby a valve 39*g* is opened between the fixed iron core 39*e* and the plunger 39*f*. Thereby, the atmosphere lead-in passage 40 is open and the diaphragm 32 (FIG. 2) is set in an expanded state. An intake orifice 31*h* which is formed in the housing 31 is connected to the diaphragm compartment 38.

Since the fixed iron core 39*e* and the plunger 39*f* are put in and touched to an internal circumference of the cylindrical projected part 31*j*, precise centering of the fixed iron core 39*e* and the plunger 39*f* on axial directions thereof is easily offered. Besides, the diaphragm compartment 38 is hermetically closed against the atmosphere by one O ring 54.

Next, construction of an exhaust solenoid valve 41 is described. An exciting coil 41*a* is wound on a bobbin 41*b*, and a pair of terminals 41*c* are provided out of a bobbin 41*b*. The bobbin 41*b* is inserted on a circumference of the cylindrical projected part 31*k*. A fixed iron core 41*e* is inserted into the projected part 31*k* and fixed within the bobbin 41*b*. An O ring 54 is fitted on the fixed iron core 41*e*. A plunger 41*f*, which serves as a movable iron core by being movably held in the cylindrical projected part 31*j*, has a buffer rubber 41*p* fitted thereon. This plunger 41*f* is urged to move leftward of the figure by a valve spring 41*h*, and thereby a valve 41*g* is closed between a valve bank 31*m* and the plunger 41*f*. An intake orifice 31*i* which is formed in the housing 31 is connected to the diaphragm compartment 38.

The fixed iron core 41*e* and the plunger 41*f* are put in and touched to an internal circumference of the cylindrical projected part 31*k*, and the valve bank 31*m* is integrally formed at a bottom part of the projected part 31*k*. Therefore, precise centering of the fixed iron core 41*e*, the plunger 41*f* and the valve bank 31*m* on axial directions thereof is easily offered. Besides, the diaphragm compartment 38 is hermetically closed against the atmosphere by one O ring 54.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A pneumatic actuator comprising:

a housing;

a case which forms an enclosed space therein together with said housing;

a diaphragm which is held in said space to form a diaphragm compartment and expands/contracts by change of an internal air pressure thereof thereby to output a displacement out of said case;

a spring which is held in said diaphragm compartment for expanding said diaphragm;

a pair of intake solenoid valves which connect/disconnect said diaphragm compartment with/from atmosphere and each of which comprises a fixed iron core through which a passage is formed for intaking air in an axial direction thereof, a movable iron core for opening/closing a valve and a spring which pushes said movable iron core by an end thereof to open said valve;

an exhaust solenoid valve which connects/disconnects said diaphragm compartment with/from negative pressure suction source;

a yoke which holds said intake solenoid valves and said exhaust solenoid valve and is fixed on said housing; and a cover which covers said intake solenoid valves and said exhaust solenoid valve and receives said other end of said spring of said intake solenoid valve; wherein said intake solenoid valves and said exhaust solenoid valve are disposed in a triangular disposition with terminal side thereof faced to said housing, and one of terminals of said each solenoid valve is secured with each other at a center part of said triangular disposition, and said other terminal of each solenoid valve is disposed outward of said triangular disposition, and wherein said spring of each intake solenoid valve passes through said passage.

2. A pneumatic actuator in accordance with claim 1, wherein said housing has fixing bases which are projected from a bottom part thereof to hold said yoke and said all solenoid valves thereon, and said cover covers said all solenoid valves and said fixing bases with a gap inbetween.

3. A pneumatic actuator in accordance with claim 1, wherein said yoke has a prolonged part at an end thereof.

4. A pneumatic actuator in accordance with claim 3, wherein said prolonged part is a radiation plate.

5. A pneumatic actuator in accordance with claim 3, wherein said prolonged part is a fixing frame of the pneumatic actuator.

6. A pneumatic actuator in accordance with claim 3, wherein said prolonged part is a heat sink whereon semiconductors of a control circuit are mounted.

7. A pneumatic actuator in accordance with claim 3, wherein said prolonged part is an earth plate for said solenoid valves or semiconductors of a control circuit.

8. A pneumatic actuator comprising:

a housing whereon a plurality of cylindrical projected parts are formed;

a case which forms an enclosed space therein together with said housing;

a diaphragm which is held in said space to form a diaphragm compartment and expands/contracts by change of an internal air pressure thereof thereby to output a displacement out of said case;

a spring which is held in said diaphragm compartment for expanding said diaphragm;

a pair of intake solenoid valves which connect/disconnect said diaphragm compartment with/from atmosphere and each of which comprises a bobbin whereon an exciting coil is wound and which is inserted on each outer circumference of said cylindrical projected parts, a fixed iron core which is mounted in said bobbin and inserted into each inner circumference of said cylindrical projected parts at an end part thereof and through which a passage is formed for intaking air in an axial direction thereof, a movable iron core which is slidably inserted into said each inner circumference of said cylindrical projected parts for opening/closing a valve, an O ring fitted between said each inner circumference of the cylindrical projected parts and said fixed iron core, and a spring which urges said movable iron core to open said valve;

an exhaust solenoid valve which connects/disconnects said diaphragm compartment with/from negative pressure suction source and comprises a bobbin whereon an exciting coil is wound and which is inserted on each outer circumference of said cylindrical projected parts, a fixed iron core which is mounted in said bobbin and inserted into each inner circumference of said cylindrical projected parts at an end part thereof, a movable iron core which is slidably inserted into said each inner circumference of said cylindrical projected parts for opening/closing a valve formed between the movable iron core and each bottom part of said cylindrical projected parts, an O ring fitted between said each inner circumference of the cylindrical projected parts and said fixed iron core, and a spring which urges said movable iron core to open said valve;

a yoke which holds said intake solenoid valves and said exhaust solenoid valve and is fixed on said housing; and a cover which covers said intake solenoid valves and said exhaust solenoid valve and receives the other end of said spring of the intake solenoid valve.

* * * * *